US005139035A

United States Patent [19]

Lasch et al.

[11] Patent Number: 5,139,035

[45] Date of Patent: Aug. 18, 1992

[54] METHOD OF AND APPARATUS FOR MANIPULATING BALES OF CONDENSED TOBACCO PARTICLES

[75] Inventors: Manfred Lasch; Klaus-Georg Hackmack, both of Hamburg; Reinhard Hohm, Pinneberg, all of Fed. Rep. of Germany; Ian E. Tatham, Purley, England; Eric H. Dennis, Skipton, England

[73] Assignees: Korber AG, Hamburg, Fed. Rep. of Germany; British-American Tobacco Company Ltd., London, England

[21] Appl. No.: 494,676

[22] Filed: Mar. 16, 1990

[30] Foreign Application Priority Data

Mar. 18, 1989 [DE] Fed. Rep. of Germany ..... 3908939

[51] Int. Cl.[5] ..... A24B 3/06

[52] U.S. Cl. ..... 131/299; 131/294; 131/295

[58] Field of Search ..... 131/299, 294, 295

[56] References Cited

U.S. PATENT DOCUMENTS 3,372,703 3/1968 Conard .
3,948,277 4/1976 Wochnowski .
4,004,594 1/1977 Wochnowski .
4,043,145 10/1977 Berndt .
4,116,203 9/1978 Wochnowski .
4,600,024 7/1986 Edwards .
4,615,343 10/1986 Komossa .
4,799,501 1/1989 Liebe .
4,898,189 2/1990 Wochnowski .
4,922,933 5/1990 Jakob ..... 131/299

FOREIGN PATENT DOCUMENTS 2138666 10/1984 United Kingdom .
2187632 9/1987 United Kingdom .

*Primary Examiner*—V. Millin
*Attorney, Agent, or Firm*—Peter K. Kontler

[57] ABSTRACT

Bales of compressed tobacco ribs and/or tobacco leaf laminae having a moisture content of 8–11 percent are advanced past a battery of microwave generators or through one or more electric high frequency fields to raise the temperature of particles in the bales to between 30° and 90° C. The bales or portions of the bales are thereupon loosened, prior to complete cooling back to starting temperature, by the pins of a conveyor which delivers the particles of loosened bales or portions of bales into the magazine of a shredding machine wherein the particles are cut. The moisture content of shreds is raised to 12–13.5 percent at which the shreds are ready for processing into smokers' products, or above 13.5 percent, for example, to between 21 and 30 percent. Such moisturizing to above the processing moisture content is or can be followed by drying of the shreds.

34 Claims, 1 Drawing Sheet

METHOD OF AND APPARATUS FOR MANIPULATING BALES OF CONDENSED TOBACCO PARTICLES

BACKGROUND OF THE INVENTION

The invention relates to the treatment of tobacco in general, and more particularly to improvements in methods of and in apparatus for manipulating packages of compacted or condensed tobacco leaf laminae and/or tobacco ribs. Still more particularly, the invention relates to improvements in methods of and in apparatus for manipulating packages of compacted tobacco particles (consisting of tobacco leaf laminae and/or tobacco ribs) wherein the particles of packages are dielectrically heated by subjecting them to the action of microwaves and/or to the action of one or more electric high frequency fields.

Harvested tobacco leaves are normally subjected to a pronounced drying action so that their moisture content is reduced to approximately 8–11 percent. The thus dried tobacco is thereupon condensed into cylindrical, block-shaped or otherwise configurated packages (hereinafter called bales for short). The particles which form the bales can consist exclusively of tobacco leaf laminae (i.e., stripped tobacco leaves (also called strips) which are devoid of ribs), exclusively of tobacco ribs, or of a mixture of laminae and ribs. If the stripping of tobacco leaves takes place prior to baling, the ribs are or can be stored separately to be cut and admixed to shredded laminae in a cigarette maker or the like. An advantage of bales of compacted laminae and/or ribs is that they can be stored for extensive periods of time and occupy little room in storage and during transport.

When the particles of the bales are to be converted into fillers of cigarette rods or other tobacco-containing rods in accordance with heretofore known procedures, the bales must be broken up, i.e., the coherent particles (be it ribs and/or laminae) must be singularized in a complex and time consuming manner. The reason is that the relatively dry and hence brittle particles strongly adhere to each other so that the separating operation must be carried out with great care in order to avoid excessive comminution of the particles prior to actual cutting (e.g., shredding). It is customary to introduce a bale into a vacuum chamber and to drive into the bale one or more hollow mandrels which serve to admit steam. The thus admitted steam tends to escape into the chamber because its pressure exceeds the pressure in the chamber. This results in heating and moisturizing of the particles, i.e., the particles become or are supposed to become supple and to be readily separable from each other. Reference may be had, for example, to U.S. Pat. No. 3,372,703. A drawback of the patented procedure is that the energy requirements of the bale breaking or loosening apparatus are very high and that such apparatus are complex, bulky and expensive. As a rule, the apparatus will raise the moisture content of particles to approximately 12–14 percent which is considered an acceptable value for enhancing the suppleness of the particles and for facilitating their separation without undue breakage. Such preliminary moisturizing to between 12 and 14 percent is followed by additional moisturizing in order to raise the moisture content to between 18 and 23 percent. This is considered by experts to be an optimum moisture content of tobacco particles which consist of tobacco leaf laminae and are about to be shredded. The moisture content of tobacco ribs which are about to be cut is raised to as high as 30 percent. A modern tobacco shredder operates with two convergent chains which subject the moisturized particles to a pronounced compressing action to form a so-called cake which is fed through a mouthpiece and into the range of a set of orbiting knives serving to convert the leader of the cake into shreds. The shreds are thereupon dried in order to reduce their moisture content to a value (e.g., between 12.5 and 13.5 percent) which is satisfactory or best suited for gathering of shreds into a stream in a cigarette rod making machine.

The above outlined steps of a conventional method of breaking up bales and of converting their particles into shreds which are ready for the making of tobacco fillers involve heating and moisturizing, additional moisturizing, pronounced compacting in the shredder and subsequent drying. This consumes much energy and contributes significantly to the cost of the ultimate products.

U.S. Pat. No. 4,799,501 to Liebe et al. discloses a modified method and apparatus wherein the vacuum chamber is replaced with a microwave oven. The oven heats the particles of bales and weakens the bonds between neighboring particles. The loosened particles are wetted in order to raise their moisture content to a value which is considered to be best suited for conversion into a cake between the convergent chains of a shredder. Shredded particles of tobacco are thereupon dried down to the moisture content which is necessary for introduction into a cigarette rod making machine. Thus, though the method and apparatus of Liebe et al. dispense with moisturizing of particles which are condensed into bales, it is still necessary to moisturize the loosened particles prior to shredding and to thereupon dry the shredded particles preparatory to further processing, e.g., into the fillers of cigarette rods. Such moisturizing and drying steps involve the expenditure of considerable amounts of energy.

Published British patent application No. 2 187 632 discloses a method and an apparatus wherein bales of condensed and relatively dry tobacco particles are heated by subjecting them to the action of microwaves. The thus treated bales are fed into a cutting or comminuting machine prior to cooling of the particles back to starting temperature. The accumulations or packages which are being fed into the cutting machine must have a predetermined width and height; therefore, it is often necessary to break up the bales into fragments for the purpose of admitting the fragments into the cutting machine. The breaking up of bales into smaller portions or fragments which are ready for admission into the cutting machine is costly and takes up much time. In addition, remnants of bales which do not have the required width and height must be shredded or otherwise comminuted in separate machines.

OBJECTS OF THE INVENTION

An object of the invention is to provide a method which renders it possible to dispense with the step of breaking up large bales into smaller accumulations of coherent tobacco particles prior to the comminuting step.

Another object of the invention is to provide a method which renders it possible to dispense with moisturizing of tobacco particles prior to the cutting step and which can be practiced without the need for comminution of bales into portions or accumulations having a given height and width.

A further object of the invention is to provide a method which renders it possible to dispense with vacuum chambers and which can be practiced in connection with the manipulation of bales containing tobacco leaf laminae and/or tobacco ribs as well as in connection with the manipulation of all available brands of tobacco including Burley, Virginia and Oriental.

An additional object of the invention is to provide a novel and improved apparatus for the practice of the above outlined method and to construct and assemble the apparatus in such a way that its energy requirements are lower than those of presently available apparatus.

Still another object of the invention is to provide an apparatus which treats the particles of tobacco leaves gently and furnishes high percentages of high-quality cut tobacco leaf laminae and/or tobacco ribs.

Another object of the invention is to provide the apparatus with novel and improved means for treating bales of tobacco particles between the heating and cutting stations.

A further object of the invention is to provide a novel and improved assembly for regulating the quantities of tobacco particles at the inlet to the comminuting station.

An additional object of the invention is to provide an apparatus which exhibits the above outlined novel features even though it employs or can employ a large number of conventional components.

Another object of the invention is to provide an apparatus which can process all particles of bales irrespective of the size and/or shape of the bales at the start of the treatment.

SUMMARY OF THE INVENTION

One feature of the present invention resides in the provision of a method of manipulating relatively dry particles of tobacco leaves in the form of tobacco ribs and/or tobacco leaf laminae which are compressed or compacted into bales. The method comprises the steps of dielectrically heating the bales from a first to a second temperature, loosening portions of or entire heated bales before the temperature of such portions of or entire bales drops back to the first temperature, and cutting the particles of loosened portions of or entire bales.

The heating step can include subjecting the bales to the action of microwaves and/or to the action of an electric high frequency field. Such heating step includes raising the temperature of the bales to at least 30° C., preferably to at least 60° C. (e.g., between 60°and 90° C.).

The method can further comprise the steps of monitoring the quantity of particles constituting loosened portions of or the entire bales, and regulating the loosening of portions of or the entire bales when the monitored quantity is outside of a predetermined range of acceptable quantities. The cutting step can comprise delivering loosened portions of or entire bales into a magazine of a shredding or other cutting machine, drawing a flow of particles from the magazine, and shredding the flow. The monitoring step can include ascertaining the quantity of particles in the magazine, and the regulating step of such method preferably comprises varying the rate of delivery of loosened portions of or entire bales into the magazine.

If the heating step includes subjecting the particles of the bales to the action of microwaves, the method preferably further comprises monitoring the temperature of the thus heated particles and reducing or terminating the action of microwaves when the particles are heated to the second temperature.

The method can further comprise the step of raising the moisture content of cut particles. Such moisturizing step can immediately follow the cutting step and can include raising the moisture content at least to a predetermined value corresponding to that at which cut particles of tobacco are converted into smokers' products. For example, the moisturizing step can include raising the moisture content from 8–11 percent (which is normally considered a preferred moisture content of bales prior to treatment) to 12–13.5 percent (which is normally considered an optimum moisture content of shreds which are to be gathered into a stream preparatory to trimming or equalizing, i.e., preparatory to conversion into the filler of a tobacco rod which is ready to be draped into cigarette paper or other suitable wrapping material to form a cigarette rod).

However, it is equally within the purview of the invention to raise the moisture content of cut particles to a value substantially above the predetermined value, for example, above 18 percent and even to as high as between approximately 21 and 30 percent.

The moisturizing step can include contacting the cut particles with steam and/or with hot water. Still further, it is often preferred to agitate the particles (e.g., in a tunnel) in the course of the contacting step.

Another feature of the invention resides in the provision of an apparatus for manipulating relatively dry particles of tobacco leaves and/or tobacco ribs (e.g., particles having a moisture content of 8–11 percent) which are compressed into bales. The improved apparatus comprises means for dielectrically heating a series of bales from a first to a second temperature, means for loosening portions of or entire bales before the temperature of such portions of or entire bales drops back to the first temperature, and means (e.g., a shredding machine) for cutting the particles of loosened portions of or entire bales. The heating means can comprise means for subjecting the bales to the action of microwaves and/or means for subjecting the bales to the action of at least one electric high frequency field. The arrangement may be such that the heating means includes means for heating the particles of the bales to a temperature of at least 30° C., preferably to a temperature of at least 60° C. (e.g., to between 60° and 90° C.).

The loosening means can include means for transporting particles of loosened bales and/or portions of bales to the cutting means, particularly to a cutting means having a magazine for particles of loosened bales and/or portions of bales. Such apparatus can further comprise variable-speed drive means for the transporting means, means for monitoring the quantity of particles in the magazine, and means for varying the speed of the drive means when the monitored quantity is outside of a predetermined range of acceptable qualities.

The apparatus can further comprise moisturizing means for raising the moisture content of cut particles. Such moisturizing means can comprise a rotary conveying drum for cut particles and means for contacting cut particles in the drum with steam and/or hot water. Alternatively, the moisturizing means can comprise a vibrating conveying tunnel for cut particles and means for contacting the cut particles in the tunnel with steam and/or hot water.

The apparatus can also comprise means for drying moisturized cut particles.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawing.

DESCRIPTION OF PREFERRED EMBODIMENTS

Figure 1:
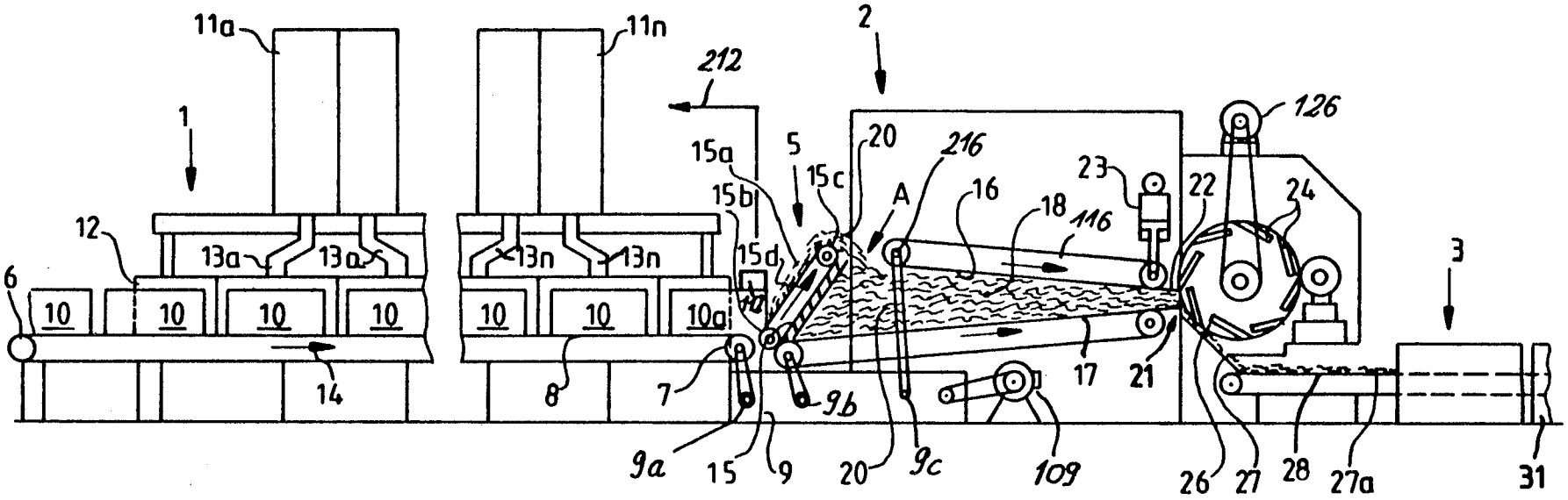
FIG. 1 is a schematic elevational view of an apparatus which embodies one form of the invention and wherein the heating unit is designed to subject the bales to the action of microwaves.

The apparatus which is shown in FIG. 1 comprises a heating unit 1 for a series of bales 10 of compacted or condensed tobacco particles, a loosening unit 5 which immediately follows the heating unit 1, a cutting unit 2 which follows the loosening unit 5, and a moisturizing unit 3 which follows the cutting unit 2. The heating unit 1 is or can be identical with that which is disclosed in the aforementioned U.S. Pat. No. 4,799,501 to Liebe et al. Reference may also be had to U.S. Pat. No. 4,600,024 to Edwards. FIG. 1 merely shows an endless belt or band conveyor 8 which is trained over pulleys 6, 7 and is driven to advance its upper reach and the series of bales 10 in the direction of arrow 14. The right-hand pulley 7 receives torque from a first output element **9*a* of a variable-speed transmission 9. This transmission receives torque from a prime mover 109. The moisture content of tobacco particles which form the bales 10 entering the heating unit 1 is or can be between 8 and 11 percent, i.e., at a value which is customary for bales leaving the storage where they were kept for as long as several years. The illustrated bales 10** are assumed to contain or consist exclusively of tobacco leaf laminae or strips; however, it is equally possible to process bales which consist, either essentially or entirely, of tobacco ribs. The modifications which must be carried out in order to treat bales of condensed ribs in lieu of bales which consist of laminae are well known to those versed in the art of treating tobacco.

The heating unit 1 comprises a battery of microwave generators **11*a* to 11*n* which are installed above a treating chamber 12 for the bales 10 on the conveyor 8. At least the top wall of the chamber 12 is not permeable to microwaves but is provided with inlets 13*a* to 13*n* for the admission of microwaves from the respective generators 11*a* to 11*n***.

The bales 10 on the conveyor 8 are heated from a first temperature (e.g., room temperature) to a second temperature of at least 30° C., preferably to a temperature of between approximately 60° and 90° C. The microwaves which are admitted via inlets **13*a* to 13*n* in the top wall of the chamber 12 ensure that the particles in the interior of each bale are heated to the same temperature as the particles forming the outer layer or layers of the bales. The heating action can be regulated by installing at the outlet of the chamber 12 one or more detectors serving to monitor the temperature of the bales 10 which are about to leave the heating unit 1 and transmit appropriate signals which are used to regulate the operation of the microwave generators, e.g., to reduce the microwave output or to shut off one or more microwave generators. FIG. 1 shows a monitoring device 112 and a conductor 212 which serves to transmit signals from the device 112 to the microwave generators 11*a* to 11*n*. One or more microwave generators 11*a* to 11*n* will be turned on or off if the generators are magnetrons, and the output of the generators 11*a* to 11*n*** is or can be varied if the generators are klystrons.

The disclosure of the aforementioned U.S. Pat. No. 4,799,501 to Liebe et al., as well as of each other patent referred to herein, is incorporated by reference.

The loosening unit 5 of the apparatus which is shown in FIG. 1 comprises an endless band or chain conveyor 15 provided with suitably inclined external pins, paddles, vanes or other suitable entraining elements **15*a*. The conveyor 15 is trained over pulleys or sprocket wheels 15*b*, 15*c* and is indirectly driven by a second output element 9*b* of the transmission 9 to advance the entraining elements 15*a* in the direction of arrow 15*d*. In accordance with a presently preferred embodiment, the entraining elements 15*a* together constitute a carding which draws particles 20 of tobacco from the foremost bale 10*a* into a magazine A of the cutting unit 2. The loosening operation at 5 is carried out before the temperature of tobacco particles 20 is permitted to drop back to the starting or first temperature corresponding to that of the leftmost bale 10 shown in FIG. 1. The conveyor 15 can be said to constitute an elevator conveyor because its left-hand reach transports freshly loosened particles 20 upwardly toward and over the upper pulley or sprocket wheel 15*c* prior to permitting the particles 20** to descend into the magazine A.

The cutting unit 2 of FIG. 1 includes a standard shredding machine, e.g., a machine of the type disclosed in U.S. Pat. No. 4,615,343 to Komossa. This machine comprises two convergent endless chains 16, 17 which convert a continuous flow of loosened tobacco particles 20 into a cake 18 advancing toward a mouthpiece 21 where the leader of the cake is severed by a set of orbiting shredding knives 24 on a driven knife drum 26. The latter is driven by a separate prime mover 126. The upper chain 16 is mounted on an elongated arm 116 which is pivotable at 218 and is biased toward the front end of the conveyor 17 by a dashpot 23 or any other suitable biasing means in order to urge the upper section 22 of the mouthpiece 21 against the leader of the cake 18 in the elongated channel between the neighboring reaches of the chains 16 and 17. The lower chain 17 is driven by the second output element **9*b* and the upper chain 16 is driven by a third output element 9*c* of the transmission 9**.

It has been found that, quite surprisingly, pronounced compacting of particles 20 in the channel between the chain conveyors 16 and 17 does not result in any, or any appreciable, comminution of such particles ahead of the knife drum 26 even though the moisture content of particles 20 which are drawn from the magazine A to form the cake 18 in the channel between the two chain conveyors 16, 17 does not or need not exceed 11 percent and is normally between 8 and 11 percent, i.e., a moisture content which is customary for storage and shipment of tobacco bales. As mentioned above, conventional methods involve raising the moisture content of tobacco particles which are about to enter the shredder to between 18 and 23 percent.

The knives 24 on the drum 26 sever from the leader of the cake 18 a series of slabs of tobacco shreds 27 which are gathered into a stream or flow 27a on the upper reach of a suitable endless belt or chain conveyor 28 which delivers the stream 27a into, and if necessary, through and beyond the moisturizing or moistening unit 3. As a rule, the temperature of shreds 27 is still above the starting or first temperature corresponding to that of the leftmost bale 10 in FIG. 1. The moisturizing unit 3 is preferably designed to raise the moisture content of tobacco shreds 27 to between 12 and 13.5 percent which is considered to be a highly satisfactory value for further processing in a cigarette rod maker, e.g., a cigarette rod maker of the type known as PROTOS which is distributed by Korber AG of Hamburg, Federal Republic Germany. The shreds 27 which leave the moisturizing unit 3 need not be dried; this brings about savings in space, equipment and energy.

However, if the manufacturer of cigarettes or other smokers' products is interested in increasing the filling power of shredded or otherwise cut particles 27 which leave the cutting unit 2, the moisture content of comminuted particles 20 can be raised above 12 or 13 percent, e.g., to 20 percent or higher such as up to 24 percent or even up to 30 percent. This necessitates the provision of a suitable drying unit a portion of which is shown in FIG. 1, as at 31.

A presently preferred moisturizing unit is disclosed in U.S. Pat. No. 4,054,145 to Berndt et al. This moisturizing unit employs a rotary particle conveying drum and means for admitting into the drum jets of steam and/or hot water to raise the moisture content of particles on their way from the receiving toward the discharging end of the drum. A somewhat similar moisturizing unit is disclosed in U.S. Pat. No. 3,948,277 to Wochnowski et al.

Alternatively, or in addition to a moisturizing unit which employs a rotary conveying drum and one or more nozzles or other suitable means for contacting the conveyed particles with steam and/or hot water, the apparatus of FIG. 1 can employ a moisturizing unit of the type disclosed in U.S. Pat. No. 4,004,594 to Wochnowski. The moisturizing unit of this patent employs a vibrating particle conveying tunnel or trough and nozzles or other suitable means for contacting the conveyed particles with steam and/or hot water. Such moisturizing devices are capable of rapidly, reliably and gently increasing the moisture content of conveyed tobacco particles in a highly predictable manner and to any desired practical value. Another moisturizing unit which employs a vibrating tunnel or trough for tobacco particles is disclosed in the published British patent application No. 2 138 666. Moisturizing units which are disclosed in U.S. Pat. No. 4,004,594 and in the published British patent application No. 2 138 666 admit steam at an elevated pressure which is often desirable because the moisture content of tobacco particles can be rapidly raised to the processing value (normally between 12 and 13.5 percent) and also because the temperature of tobacco particles can be raised up to and above 100° C. Water, particularly hot water, is admitted if the moisture content is to be raised above or well above the aforediscussed processing moisture content of 12–13.5 percent.

The heating unit 1 (which exposes the particles 20 of the bales 10 to the action of microwaves) can be replaced with another dielectric heating unit, particularly with a heating unit which subjects the bales to the action of an electrical high frequency (capacitor) field. Such unit can operate in the megahertz range (e.g., 10 to 20 megahertz). Reference may be had to U.S. Pat. No. 4,898,189 to Wochnowski.

The method and apparatus of the invention can be practiced with equal or similar advantage for the manipulation of portions of bales, e.g., of portions of relatively large bales which are broken up for the purpose of introduction into the heating unit 1. The exact configuration of bales or portions of bales which reach the loosening unit 5 is of no consequence. All that counts is to ensure that the bales or portions of bales are loosened prior to cooling of their particles back to the first or starting temperature at the inlet of the heating unit 1. It has been found that dielectric heating enhances the suppleness of particles 20 which form the bales 10. This is due to the fact that dielectric heating results in dissolution of crystals in and/or on the particles 20. Loosening prior to cooling back to the starting temperature is desirable in order to ensure that renewed formation of crystals does not begin before the particles are sufficiently loose to be readily separated during transport by the conveyor 15 from the outlet of the chamber 12 into the magazine A of the cutting unit 2.

The term "loosening" is not intended to denote only and exclusively complete loosening of bales 10 into discrete particles 20. Thus, this term is intended to also embrace breaking up of bales into discrete particles 20 or into relatively small accumulations (e.g., clumps) of particles which do not interfere with the formation of a homogeneous cake 18 in the channel between the convergent conveyors 16, 17 of the cutting unit 2.

As already mentioned above, it often suffices if the heating unit 1 or another suitable dielectric heating oven heats the particles of the bales to a temperature of 30° C. or only slightly above 30° C. However, separation of particles 20 which form the bales 10 or portions of such bales is more pronounced if the dielectric heating unit is designed to raise the temperature of all layers of each bale to between 60° and 90° C. On the other hand, it is often desirable to raise the temperature of tobacco particles as little as possible (as long as the raised temperature suffices to ensure satisfactory loosening of the bales) in order to reduce changes in the taste or flavor of tobacco which is about to be shredded or otherwise comminuted in the unit 2 or another cutting unit.

The magazine A constitutes a desirable and advantageous but optional feature of the improved apparatus. An advantage of this magazine is that it further enhances the uniformity of the rate of admission of freshly loosened heated tobacco particles 20 into the channel between the chain conveyors 16 and 17. The magazine A ensures the development and maintenance of a continuous flow or stream which enters the channel between the conveyors 16, 17 and thus guarantees the formation of a homogeneous cake 18 which is ready to be cut by the orbiting knives 24 at the discharge end of the mouthpiece 21.

Moisturizing of shreds 27 which form the stream 27a on the conveyor 28 can, and preferably does, take place prior to cooling of shreds back to starting temperature. This preferably holds true irrespective of whether the shreds 27 constitute fragments of tobacco leaf laminae and/or fragments of tobacco ribs. A moisture content of 12–13.5 percent (at room temperature) is preferred if the apparatus of the present invention is to deliver shreds to a cigarette rod making machine or to a battery of cigarette rod making machines. Such moisturizing from approximately 8–11 percent to approximately 12–13.5 percent ensures that the energy requirements of the apparatus are much lower than those of conventional apparatus wherein the particles must be moisturized prior to introduction into the cutting unit.

The shreds can be treated with one or more flavoring agents, such as casing and/or others, during moisturizing. Moreover, if the bales consist of or contain Burley tobacco, their particles are or can be heated to a temperature which is required to expel ammonia.

The shreds 27 can be mixed with shreds of other types of tobacco, for example, with expanded tobacco ribs or with other forms of tobacco. A suitable blending method and apparatus are disclosed in U.S. Pat. No. 4,116,203 to Wochnowski. Such mixing or blending can take place downstream of the moisturizing unit 3 or downstream of the drying unit 31.

Figure 2:
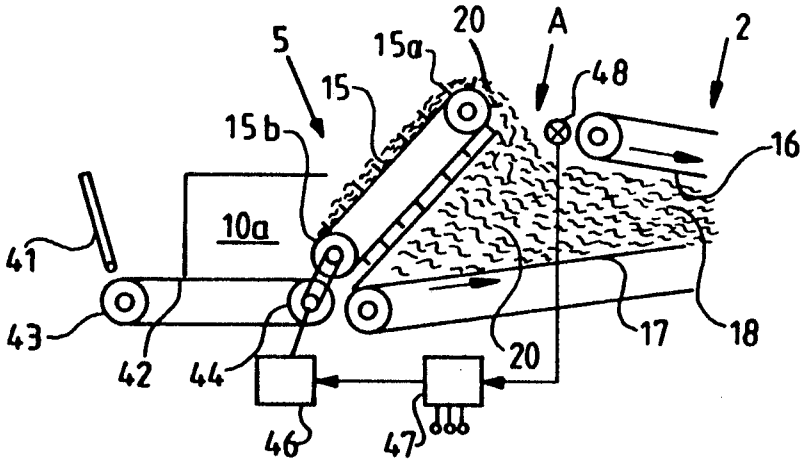
FIG. 2 is an enlarged view of a detail in a modified apparatus with a modified drive for the conveyor of the loosening means downstream of the heating unit.

FIG. 2 shows a portion of a modified apparatus. All such parts of this apparatus which are identical with or clearly analogous to corresponding parts of the apparatus of FIG. 1 are denoted by similar reference characters. The loosening unit 5 of the apparatus of FIG. 2 is separated from the outlet of the heating chamber 12 (not shown in FIG. 2) by a receptacle for discrete bales 10. The bale 10*a* which has left the heating chamber 12 is located on the upper reach of an endless conveyor 42 which forms part of the receptacle and is adjacent a chute 41 for successive freshly heated bales. The conveyor 42 is trained over pulleys 43, 44 and the pulley 44 is driven by a variable-speed drive 46. The pulley 44 transmits torque to the lower pulley or sprocket wheel 15*b* for the conveyor 15. The means for varying the speed of the drive 46 comprises a control amplifier 47 which receives appropriate signals from a monitoring device 48 in the magazine A of the cutting unit 2. Signals from the monitoring device 48 cause the amplifier 47 to change the speed of the drive 46 when the monitored quantity of loosened particles 20 in the magazine A is outside of an acceptable range of quantities such as is best suited to ensure that the channel between the convergent chain conveyors 16, 17 of the cutting unit 2 receives a constant flow of loosened particles 20. The monitoring device 48 can comprise a single photoelectronic level detector or a battery of detectors which are mounted at different levels.

The receptacle including the chute 41 and the conveyor 42 is sufficiently close to the heating unit 1 and to the cutting unit 2 to ensure that the temperature of particles 20 which enter the magazine A is above the starting or first temperature (prior to heating of the respective bale 10 in the unit 1). Signals from the detector 48 can cause acceleration or deceleration of the drive 46 and hence of the conveyors 15, 42, depending on the ascertained level of the supply of heated tobacco particles 20 in the magazine A. This ensures predictable operation of the cutting unit 2 which severs heated particles 20 at a constant rate.

An advantage of the apparatus which embodies the structure of FIG. 2 is that the rate at which the unit 5 loosens successive bales or portions of bales is directly related to the requirements of the cutting unit 2, i.e., to the optimum rate of admission of a flow of loosened and heated particles 20 into the channel between the conveyors 16 and 17. Thus, the rate at which the conveyor 15 loosens the bale 10*a* on the conveyor 42 is increased if the requirements of the unit 2 are increased and vice versa. This ensures that the temperature of loosened particles 20 in the magazine A does not drop to or even below the starting or first temperature prior to conversion of such particles into an increment of the cake 18.

The apparatus which are shown in FIGS. 1 and 2 can be used with advantage for the manipulation of bales which contain relatively dry Burley tobacco. However, it is equally possible to employ the improved apparatus for the manipulation of bales which contain Virginia or Oriental tobacco, e.g., when the cigarette manufacturing plant is to make cigarettes wherein the filler is a blend of two or more different tobacco types.

The surprising discovery that tobacco particles which are merely heated but need not be moisturized can be properly shredded even though they are delivered to a cutting unit immediately upon loosening of bales having a moisture content well below the heretofore proposed moisture content for shredding results in substantial savings in energy and equipment. Thus, the bales are merely heated and loosened to an extent which is necessary to ensure the formation of a satisfactory cake 18 so that the only moisturizing which is necessary is that which is desirable in order to raise the moisture content from approximately 8–11 percent to approximately 12–13.5 percent if the particles 20 are prepared for conversion into the filler of a cigarette rod. As already mentioned above, tobacco particles which are treated in the aforediscussed manner (i.e., dielectric heating followed by loosening but without moisturizing) can readily withstand compressive stresses between the chains of the cutting unit. In fact, the quality of shreds which are obtained from the thus processed bales at least matches the quality of shreds which are obtained as a result of severing premoisturized tobacco particles.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A method of manipulating relatively dry particles of tobacco leaves in the form of tobacco ribs and/or tobacco leaf laminae which are compressed into bales, comprising the steps of dielectrically heating the bales or portions thereof from a first to a second temperature without increasing the moisture content of the bales; loosening portions of or entire heated bales before the temperature of such portions of or entire bales drops back to said first temperature and without increasing the moisture content of portions of or entire bales; and cutting the particles of loosened portions of or entire bales without increasing the moisture content of loosened portions of or entire bales.

2. The method of claim 1, wherein said heating step includes subjecting the bales to the action of microwaves.

3. The method of claim 1, wherein said heating step comprises subjecting the bales to the action of an electric high frequency field.

4. The method of claim 1, wherein said heating step comprises raising the temperature of bales to at least 30° C.

5. The method of claim 1, wherein said heating step comprises raising the temperature of the bales to at least 60° C.

6. The method of claim 1, further comprising the steps of monitoring the quantity of particles constituting the loosened portions of or the entire bales and regulating the loosening of portions of or the entire bales when the monitored quantity is outside of a predetermined range of quantities.

7. The method of claim 6, wherein said cutting step comprises delivering loosened portions of or entire bales into a magazine, drawing a flow of particles from the magazine, and shredding the flow, said monitoring step including ascertaining the quantity of particles in the magazine and said regulating step including varying the rate of delivery of loosened portions of or entire bales into the magazine.

8. The method of claim 1, wherein said heating step includes subjecting the particles of bales to the action of microwaves, monitoring the temperature of the thus heated particles, and reducing or terminating the action of microwaves when the particles are heated to said second temperature.

9. The method of claim 1, further comprising the step of raising the moisture content of cut particles.

10. The method of claim 9, wherein said step of raising the moisture content immediately follows said cutting step.

11. The method of claim 9, wherein said step of raising the moisture content includes raising the moisture content at least to a predetermined value corresponding to that at which the cut particles are converted into smokers' products.

12. The method of claim 11, wherein said step of raising the moisture content includes raising the moisture content from approximately 8–11 percent to approximately 12–13.5 percent.

13. The method of claim 11, wherein said step of raising the moisture content includes raising the moisture content to a value substantially above said predetermined value.

14. The method of claim 13, wherein said step of raising the moisture content includes raising the moisture content above 18 percent.

15. The method of claim 14, wherein said step of raising the moisture content includes raising the moisture content to between approximately 21 and 26 percent.

16. The method of claim 9, wherein said step of raising the moisture content includes contacting cut particles with steam.

17. The method of claim 16, further comprising the step of agitating the cut particles in the course of said contacting step.

18. Apparatus for manipulating relatively dry particles of tobacco leaves in the form of tobacco ribs and/or tobacco leaf laminae which are compressed into bales, comprising means for dielectrically heating a series of bales or portions thereof from a first to a second temperature without increasing the moisture content of the bales; means for loosening portions of or entire bales before the temperature of such portions of or entire bales drops back to said first temperature and without increasing the moisture content of the portions of or entire bales; and means for cutting the particles of loosened portions of or entire bales without increasing the moisture content of loosened portions of or entire bales.

19. The apparatus of claim 18, wherein said heating means comprises means for subjecting the bales to the action of microwaves.

20. The apparatus of claim 18, wherein said heating means comprises means for subjecting the bales to the action of at least one electric high frequency field.

21. The apparatus of claim 18, wherein said heating means includes means for heating the particles of the bales to a temperature of at least 30° C.

22. The apparatus of claim 18, wherein said heating means comprises means for heating the bales to a temperature of at least 60° C.

23. The apparatus of claim 18, wherein said loosening means includes means for transporting particles of loosened bales and/or portions of bales to said cutting means.

24. The apparatus of claim 23, wherein said cutting means comprises a magazine for particles of loosened bales and/or portions of bales, and further comprising variable-speed drive means for said transporting means, means for monitoring the quantity of particles in said magazine, and means for varying the speed of said drive means when the monitored quantity is outside of a predetermined range of quantities.

25. The apparatus of claim 18, further comprising moisturizing means for raising the moisture content of cut particles.

26. The apparatus of claim 25, wherein said moisturizing means comprises a rotary conveying drum for cut particles and means for contacting cut particles in the drum with steam.

27. The apparatus of claim 25, wherein said moisturizing means comprises a rotary conveying drum for cut particles and means for contacting the particles in the drum with hot water.

28. The apparatus of claim 25, wherein said moisturizing means comprises a vibrating conveying tunnel for cut particles and means for contacting the cut particles in the tunnel with steam.

29. The apparatus of claim 25, wherein said moisturizing means comprises a vibrating conveying tunnel for cut particles and means for contacting the cut particles in the tunnel with hot water.

30. The apparatus of claim 25, further comprising means for drying moisturized cut particles.

31. A method of manipulating relatively dry particles of tobacco leaves in the form of tobacco ribs and/or tobacco leaf laminae which are compressed into bales, comprising the steps of dielectrically heating the bales from a first to a second temperature; loosening portions of or entire heated bales before the temperature of such portions of or entire bales drops back to said first temperature; cutting the particles of loosened portions of or entire bales; monitoring the quantity of particles constituting the loosened portions of or the entire bales; and regulating the loosening of portions of or the entire bales when the monitored quantity is outside of a predetermined range of quantities.

32. The method of claim 31, wherein said cutting step comprises delivering loosened portions of or entire bales into a magazine, drawing a flow of particles from the magazine, and shredding the flow, said monitoring step including ascertaining the quantity of particles in the magazine and said regulating step including varying the rate of delivery of loosened portions of or entire bales into the magazine.

33. A method of manipulating relatively dry particles of tobacco leaves in the form of tobacco ribs and/or tobacco leaf laminae which are compressed into bales, comprising the steps of dielectrically heating the bales from a first to a second temperature; loosening portions of or entire heated bales before the temperature of such portions of or entire bales drops back to said first temperature; cutting the particles of loosened portions of or entire bales; and raising the moisture content of cut particles immediately following said cutting step.

34. Apparatus for manipulating relatively dry particles of tobacco leaves in the form of tobacco ribs and/or tobacco leaf laminae which are compressed into bales, comprising means for dielectrically heating a series of bales from a first to a second temperature; means for loosening portions of or entire bales before the temperature of such portions of or entire bales drops back to said first temperature; means for cutting the particles of loosened portions of or entire bales, said loosening means including means for transporting particles of loosened bales and/or portions of bales to said cutting means and said cutting means comprising a magazine for particles of loosened bales and/or portions of bales; variable-speed drive means for said transporting means; means for monitoring the quantity of particles in said magazine; and means for varying the speed of said drive means when the monitored quantity is outside of a predetermined range of quantities.

* * * * *